US009583904B2

(12) United States Patent
Battenfeld

(10) Patent No.: US 9,583,904 B2
(45) Date of Patent: Feb. 28, 2017

(54) CRIMPING PLIERS

(71) Applicant: WEZAG GmbH Werkzeugfabrik, Stadtallendorf (DE)

(72) Inventor: Kurt Battenfeld, Ebsdorfergrund/Wittelsberg (DE)

(73) Assignee: WEZAG GMBH WERKZEUGFABRIK, Stadtallendorf (DE)

( * ) Notice: Subject to any disclaimer, the term of this patent is extended or adjusted under 35 U.S.C. 154(b) by 0 days.

(21) Appl. No.: 14/887,546

(22) Filed: Oct. 20, 2015

(65) Prior Publication Data

US 2016/0111840 A1 Apr. 21, 2016

(30) Foreign Application Priority Data

Oct. 20, 2014 (EP) ..... 14189552

(51) Int. Cl.
*H01R 43/042* (2006.01)
*B21J 7/16* (2006.01)
(Continued)

(52) U.S. Cl.
CPC ..... *H01R 43/042* (2013.01); *B21J 7/16* (2013.01); *B25B 7/06* (2013.01); *B25B 7/123* (2013.01); *H01R 43/0424* (2013.01)

(58) Field of Classification Search
CPC H01R 49/0428; H01R 43/0424; B25B 7/123; B25B 7/06; B25B 7/12; B25B 7/16; B25B 27/146; B21J 7/16
(Continued)

(56) References Cited

U.S. PATENT DOCUMENTS 2,079,498 A * 5/1937 Douglas ..... H01R 43/0424 72/402
3,226,968 A * 1/1966 Holmes ..... H01R 43/0424 72/31.04
(Continued)

FOREIGN PATENT DOCUMENTS

DE 19709639 9/1998
DE 19713580 12/1999
(Continued)

*Primary Examiner* — David B Jones
(74) *Attorney, Agent, or Firm* — Thomas | Horstemeyer, LLP

(57) ABSTRACT

The inventions relates to crimping pliers with two hand levers (3, 5) and two actuation elements (9, 10) located in the region of a pliers head (4). The actuation elements (9, 10) actuates dies (12) between which a workpiece can be crimped. A toggle lever drive (33) with two toggle levers (34, 35) which build a toggle lever angle (36) acts between the hand levers (3, 5) and the actuation elements (9, 10). One toggle lever (34) is built by a roller (23) which is pivotably mounted to the hand lever (5). The roller (23) rolls along a curved track (24) fixed at the other hand lever (3). A forced locking unit (48) is built with a toothed latching lever (28) which is supported for being rotated relatively to the roller (23).
A lever part (30) of the toothed latching lever (28) is coupled by a sliding guide to the hand lever (3), whereas the other lever part (29) of the toothed latching lever (28) forms a toothing (31) for latching of the forced locking unit (48).

19 Claims, 14 Drawing Sheets

(51) Int. Cl.
*B25B 7/12* (2006.01)
*B25B 7/06* (2006.01)

(58) Field of Classification Search
USPC ..... 72/409.12
See application file for complete search history.

(56) References Cited

U.S. PATENT DOCUMENTS 3,459,029 A * 8/1969 Rosenfeld ..... H01R 43/0424 72/31.12
D341,303 S 11/1993 Davis
5,261,263 A * 11/1993 Whitesell ..... B25B 27/146 29/237
5,913,933 A 6/1999 Beetz et al.
5,918,511 A * 7/1999 Sabbaghian ..... B25B 13/10 81/128
6,176,116 B1 * 1/2001 Wilhelm ..... B25B 27/146 72/402
6,286,358 B1 9/2001 Beetz et al.
6,289,712 B1 9/2001 Beetz et al.
6,474,130 B2 11/2002 Battenfeld
6,612,206 B1 9/2003 Heggemann et al.
6,889,579 B1 * 5/2005 Brown ..... B23D 21/06 81/58
7,155,954 B2 1/2007 Battenfeld
7,874,193 B2 * 1/2011 Norin ..... H01R 43/0424 72/402
7,997,116 B2 * 8/2011 Norin ..... B25B 27/10 72/409.08
8,087,280 B2 1/2012 Battenfeld et al.
8,127,589 B2 3/2012 Battenfeld
8,286,461 B2 10/2012 Hofmann et al.
8,474,299 B2 * 7/2013 Lutze ..... H01R 43/0424 72/402
8,613,210 B2 * 12/2013 Wagner ..... B25B 27/146 72/20.1
9,242,349 B2 * 1/2016 Battenfeld ..... B25B 7/123
2015/0180190 A1 * 6/2015 Dierks ..... H01R 43/0424 29/751

FOREIGN PATENT DOCUMENTS

| | | |
|---|---|---|
| DE | 29914764 | 2/2001 |
| DE | 19963097 | 4/2001 |
| DE | 19924087 | 6/2002 |
| DE | 19924086 | 8/2002 |
| DE | 10346241 | 8/2004 |
| DE | 102007056262 | 11/2008 |
| DE | 102008007303 | 12/2009 |
| DE | 102007001235 | 6/2010 |
| DE | 202012102561 | 12/2013 |
| DE | 102013 100 891 | 7/2014 |
| EP | 0732779 | 9/1998 |
| EP | 1820607 | 8/2007 |
| WO | 2014118190 | 8/2014 |

* cited by examiner

CRIMPING PLIERS

CROSS REFERENCE TO RELATED APPLICATIONS

This application claims priority to co-pending European Patent Application No. EP 14 189 552.4 entitled "Presszange", filed Oct. 20, 2014.

FIELD OF THE INVENTION

The invention relates to crimping pliers for crimping a workpiece. This covers any crimping pliers, e.g. crimping pliers for crimping tube connections or wire connections or crimping pliers (also denoted as pressing pliers) for crimping connections of electrical lines or plugs, sleeves, bushings or connectors with any electrical cable. The crimping pliers might generally have any of the plurality of available designs, wherein during the crimping process the crimping is performed with two or more than two dies or mandrels (in the following together named "dies"). It is possible that the crimping pliers are actuated by an external force, e.g. by an electrical drive. However, preferably the crimping pliers are actuated by hand forces.

BACKGROUND OF THE INVENTION

During the crimping process of a workpiece the increasing plastical deformation of the workpiece between the dies requires a crimping force which increases during the crimping process. For known crimping pliers the hand forces manually applied upon hand levers of the crimping pliers are transmitted to the dies by a drive mechanism such that it is possible to generate the required maximal crimping forces by manual actuation of the hand levers.

The publications DE 197 13 580 C2, DE 197 09 639 A1, DE 199 24 086 C2, DE 199 24 087 C2, DE 199 63 097 C1, DE 103 46 241 B3, DE 10 2007 001 235 B4, DE 10 2008 007 303 B4 disclose embodiments of crimping pliers wherein the drive mechanism is built with a toggle lever drive. Here, the crimping pliers are built with a C-shaped pliers head in which crimping jaws are moved with a translational movement towards each other by the toggle lever drive. It is also possible that the pliers head has a "scissors-like" design with crimping jaws being pivot-mounted at each other. Here, a toggle lever of the toggle lever drive is linked to one of the crimping jaws. During the working stroke from an open position into a closed position of the crimping pliers the toggle lever angle built between the toggle levers in the region of the toggle lever joint changes. When approaching the closed position, the toggle lever angle approximates an angle of 180°. This kinematic of the toggle lever drive has the consequence that at the beginning of the working strokes small crimping forces are produced with a comparatively large closing movement of the pliers jaws during a part of the stroke of the hand levers, and at the end of the working stroke large crimping forces are produced with a small closing movement of the pliers jaws in the corresponding part of the stroke of the hand levers. Here, the chosen lengths of the toggle levers and the linking points of the toggle levers at the hand levers and pliers jaws and accordingly the angular setting determine the characteristic of the closing movement of the pliers jaws and the produced crimping forces dependent on the closing movement of the hand levers.

The publication of the design U.S. 341,303 discloses crimping pliers for crimping fittings for tube connections.

For these crimping pliers it is possible to pivot the pliers jaws about a common rotational joint. A pliers jaw is rigidly connected with a fixed hand lever, whereas the other pliers jaw is coupled by a pivoting joint with a movable hand lever. Here, a toggle lever drive is built according to the principle "roller-curve" as follows: A roller is mounted for pivoting about a roller axis at the fixed hand lever. The movable hand lever carries a guiding part which forms a curved track. For a movement of the hand levers towards each other the movable hand lever is supported with the curved track at the roller which is pivot-mounted at the fixed hand lever. In this case, one toggle lever is built by the roller, namely the material region of the roller extending between the contact point of the roller at the curved track and the roller axis. Instead, the other toggle lever is built between the contact point between the roller and the curved track and the pivot axis at which the movable hand lever is linked to the movable pliers jaw. The "toggle lever joint" is for this embodiment built by the rolling contact of the roller with the curved track so that there is no "joint" in the classical sense. If during the closing movement of the hand levers the roller rolls along the curved track, dependent on the contact point of the roller with the curved track the length of the last mentioned toggle lever changes and the position of the toggle lever joint at the curved track changes. Accordingly, by the choice of the geometry of the curved track, it is possible to additionally affect the characteristic of the crimping pliers.

For crimping pliers so-called forced locking units are used which serve for the following purposes:

a) By use of a forced locking unit it is intended to provide that it is only possible to open the hand levers and accordingly to open the crimping pliers when having completely run through the whole working stroke of the crimping pliers so that the crimping process has completely been terminated.

b) It is possible that during travel through the working stroke after a part of the stroke the actuating forces applied by the user to the hand levers are reduced. This might e.g. be the case for an interruption of the crimping process or if the user intends to change the gripping of the crimping pliers so that the user changes his grip. If there was a reduction of the crimping force, this might result in a dislocation of the workpiece relative to the die which is undesired. Once a partial crimping step is reached, by use of the forced locking unit it is possible to secure the reached partial crimping step so that also for a reduction or removal of actuating forces applied upon the hand levers the crimping jaws are not able to perform an opening movement or are only able to perform an opening movement of reduced extent.

Crimping pliers having a forced locking unit are e.g. known from DE 20 2012 102 561 U1, DE 10 2013 100 891 A1, DE 299 14 764 U1 and EP 1 820 607 A2.

DE 10 2007 056 262 A1 discloses crimping pliers wherein a toggle lever drive is built according to the above explained principle roller-curve. In these crimping pliers a forced locking unit is used. Here, a toothing of the forced locking unit is located at the end region of the movable pliers jaw facing away from the die, whereas a spring-biased latching pawl of the forced locking unit is pivot-mounted to the movable hand lever.

For the formation of the drive mechanism with a toggle lever drive without use of the principle roller-curve, usually a toothing of a forced locking unit is built by a protrusion of a toggle lever which is also denoted as a pressure lever. This toothing cooperates with a latching pawl which is pivot-mounted to the movable hand lever under the bias of a spring (cp. EP 0 732 779 B1).

SUMMARY OF THE INVENTION

The invention relates to crimping pliers of any design by which a crimping of a workpiece is provided. The crimping pliers comprise two drive elements which are preferably built by manually actuated hand levers. Furthermore, the crimping pliers have two actuating elements located in the region of a pliers head. The actuating elements actuate dies between which it is possible to crimp the workpiece. It is possible that the actuating elements are directly built by pliers jaws which (integrated or made in one piece or made in a plurality of pieces) carry the dies. However, it is also possible that the actuating elements are coupled with the dies by a transmission. It is e.g. possible that according to EP 0 732 779 B1 the actuating elements are built by a pivot ring and a bearing plate. Here, a plurality of dies is pivot-mounted to the bearing plate, and the plurality of dies is guided in the end regions in grooves of the pivot ring such that with a pivoting movement of the pivot ring relative to the bearing plate it is possible to generate a common movement of the dies by which the crimping of the workpiece is provided.

With the novel crimping pliers, it is possible to provide crimping pliers with extended options for the design of the characteristic when at the same time using a forced locking unit.

For the inventive crimping pliers a toggle lever drive acts between the drive elements and the actuating elements. The toggle lever drive comprises two toggle levers. The toggle levers build a toggle lever angle which changes over the working stroke. Here, it is possible that the two toggle levers are connected to each other in the region of a real toggle lever joint. However, it is also possible that a toggle lever joint is formed in the region of a contact between a roller and a curved track.

By a suitable choice of the geometry of the curved track it is in some case possible to each define a toggle lever angle over the working stroke which fulfills the needs. By the rolling movement of the roller along the curved track of the guiding part it is e.g. possible to attempt to keep the toggle lever angle within a region of angles (e.g. from 130° to 190°, in particular 145° to 180°) independent on the workpiece which is to be crimped.

For the inventive embodiment the principle roller-curve is used. Here, a toggle lever is built by a roller. The roller is pivot-mounted to a hand lever for pivoting about a roller axis. The roller rolls along a curved track which is rigidly connected to the other hand lever. Here it is possible that a) the roller is pivot-mounted to the fixed hand lever, whereas the curved track is fixedly connected to the movable hand lever, or b) the roller is pivot-mounted to the movable hand lever, whereas the curved track is fixed to the fixed hand lever.

According to the invention, the forced locking unit has a design as follows:

A toothed latching lever is linked to the drive element at which the roller is pivot-mounted. Here, the toothed latching lever is both pivotable relative to the drive element at which the roller is pivot-mounted as well as relative to the roller itself. A lever part of the toothed latching lever is coupled to the other drive element by a sliding guide. The other lever part of the toothed latching lever forms a toothing for latching of the forced locking unit.

According to the invention the toothed latching lever and the associated toothing for latching of the forced locking unit is not formed by a pliers jaw or the actuating element. The toothed latching lever is also not integrally built by a toggle lever or a pressure lever of the toggle lever drive. These formations of the toothed latching lever not used according to the invention in particular have the disadvantage that necessarily the movement of the toothed latching lever corresponds to the movement of the pliers jaw or the toggle lever or the pressure lever. Instead, according to the invention, the extent of the movement of the pliers jaw and of the roller with the movement along the curved track might differ from the movement of the toothed latching lever. Dependent on the design of the sliding guide it is possible to specifically influence the extent of the movement of the toothed latching lever such that (under the assumption of a fixed defined toothing width of the toothing for latching) by the sliding guide it is possible to influence the sensitivity of the operation of the forced locking unit and the number of the securable partial crimping steps of the forced locking unit. Also by the geometric design of the toothing for locking and of the toothed latching lever the invention removes the dependency on the design of the pliers jaws and the toggle lever or pressure lever. The length of the toothed latching lever, an extension of the toothing for latching in circumferential direction, a possible angled design of the toothed latching lever, the distance of the roller axis from the sliding guide and the geometry of the sliding guide can be freely defined by constructive measures.

Generally, the toothed latching lever can be rotatably mounted at any position of the drive element at which the roller is rotatably mounted. A specifically compact design of the inventive crimping pliers results if the toothed latching lever is mounted to the drive element for a rotation about the roller axis about which the roller is rotated.

Any design of the sliding guide is possible, e.g. with a one-sided or two-sided guiding track. For a very simple design of the invention, the sliding guide is built with an elongated hole. It is possible to provide a guiding along the elongate hole which is free of play in a direction transverse to the extension of the elongated hole or at least in a part with some play. Here, it is possible that the elongated hole is straight or curved or also formed with bucklings or steps.

A very compact design of the inventive crimping pliers results if the bearing bolt is used in a multifunctional way by using the bearing bolt both for bearing the roller on the same as well as for bearing the toothed latching lever.

It is also possible that another bearing bolt is used in a multifunctional way by using the other bearing bolt both for guiding the toothed latching lever against the sliding guide as well as for fixing a guiding part forming the curved track.

As explained in the beginning, by use of the toggle lever drive, the use of the principle roller-curve and of the explained design of the forced locking unit it is possible to influence the characteristic of the crimping pliers by constructive measures and to define the interrelation with the forced locking unit. Furthermore, the behavior of the crimping pliers might for an advantageous embodiment of the invention be influenced by a force-displacement-compensation element built by a spring element. The use of a force-displacement-compensation element in the crimping pliers bases upon the following considerations:

It is advantageous if it is not only possible to use crimping pliers for crimping of workpieces with one single geometry, one single material stiffness and/or one single cross-sectional area (in the following together simplified as "cross-sectional area") but to use the crimping pliers in a multifunctional way also for different workpieces with differing cross-sectional areas. However, in the case of a rigid design of the components of the crimping pliers, the crimping pliers are designed for crimping a workpiece with a specific cross-sectional area. The use of the crimping pliers for a workpiece with a smaller cross-sectional area has the consequence that for this use the required maximal crimping forces will not be reached, whereas for the use of the crimping pliers for workpieces with larger cross-sectional areas the maximum crimping forces are already produced after a part of the stroke of the hand levers so that the complete closure of the hand levers would result in excess crimping forces or the complete closing of the hand levers is not possible by manual actuating forces. As a remedial measure, a force-displacement-compensation element is used in the force flow from the hand levers to the pliers jaws. The force-displacement-compensation element has the consequence that the crimping of a workpiece with a cross-sectional area being too large due to the elasticity does no (only) lead to a plastic deformation of the workpiece but instead leads to an elastic effect so that in the ideal case it is possible to close the hand levers without any further plastic deformation of the workpiece solely under an elastic deformation of the force-displacement-compensation element. Examples for a force-displacement-compensation element which might also be used within the frame of the present invention can e.g. be taken from

- the publication EP 0 732 779 B1 where the location of a support of the toggle lever drive (so within the frame of the invention the roller axis or the curved track) has a resilient design for providing the force-displacement-compensation element and/or where by a narrowing the hand lever has an elastic design,
- the publications EP 0 158 611 B1 and DE 31 09 289 C2 wherein a toggle lever has an elastic support, or
- the non-published European patent application EP 14 154 206.8 where a toggle lever or pressure lever itself has a resilient design.

However, preferably the spring element building the force-displacement-compensation element is (differing from the above mentioned embodiments known from the prior art) located in the region of the pliers head: It is possible that the spring element building the force-displacement-compensation element is located in the force flow between the toggle lever drive and the pliers jaws or actuating elements so that the force-displacement-compensation element is located behind or downstream from the toggle lever drive. Here it is possible that a spring base of the spring element building the force-displacement-compensation element is mounted at or linked with an actuation element, in particular a pliers jaw or a pivot ring.

For the design of the spring element building the force-displacement-compensation element there are a lot of options. For one particular proposal of the invention, the spring element is built by a bending beam. Here the bending beam might have any geometry, e.g. with a straight or curved or bent design. By choice of the curvature of a neutral fiber of the bending beam, of the material of the spring element and of the bending stiffness, in particular the geometrical moment of inertia, it is possible to specifically influence the elasticity of the spring element and the deformation characteristic of the spring element.

For a particular embodiment of this idea, the spring element built by a bending beam has a plate design. The plate design permits a very simple production of the spring element. Dependent on the design of the single plates of the spring element, it is possible to specifically define and to define with a high accuracy the elastical behavior of the spring element. It is even possible that crimping pliers with different characteristics of the force-displacement-compensation element are provided by using a different number of plates, the plates being identical for the different spring elements except the number of plates used. In some cases, a plate design is also advantageous if the spring element is built integrally with another component of the crimping pliers, in particular an actuation element or the pivot ring, so that both a production of the spring element as well as of the other component can be done with one and the same plate and the manufacturing method used therefore.

Another embodiment of the invention addresses the integration of the spring element into the pliers head. For this embodiment it is proposed that the spring element (at least partially) extends in circumferential direction around a die axis. Here, it is possible that the spring element extends with a circumferential angle of e.g. more than 90°, more than 180° or even more than 270° around the die axis. It is possible that the spring element extends in circumferential direction with a plurality of straight partial regions being inclined one against the other. However, any curved extension of the spring element in circumferential direction is also possible.

For a preferred embodiment of the invention, the spring element is formed by a spring having the shape of an arc of a circle or by a spiral spring. For such a spring with the shape of an arc of a circle or spiral spring an advantageous characteristic of the spring element results. In some cases also large spring displacements are possible. It is also possible that by a spring element of this type an elasticity is provided which is both effective in circumferential direction about the die axis as well as in a direction radial to the die axis. This might be in particular advantageous for the integration of the spring element into the force flow between the drive elements, the drive mechanism and the actuation elements or dies.

In the case that the spring element has the design of a bending beam, the progression of the bending stiffness along the longitudinal axis of the bending beam is arbitrary. For a preferred embodiment of the invention, the bending beam has a bending stiffness which varies along its (straight or curved) longitudinal axis. For a particular embodiment of the crimping pliers, the geometric moment of inertia of the bending beam increases from the spring base at which the spring is biased by the drive mechanism to a cross-section of the bending beam located opposite in circumferential direction to this spring base, wherein the increase might progress continuously or in steps. For another embodiment of the inventive crimping pliers, the geometric moment of inertia of the bending beam is symmetrical to a symmetry axis. The symmetry axis runs approximately or exactly through the spring base at which the spring is biased by the drive mechanism and runs through the cross-section of the bending beam which is located opposite to this spring base in circumferential direction. Here, the die axis is preferably located on the afore mentioned symmetry axis. An embodiment of this type has proven to be particularly advantageous for the design of tensions in the bending beam and/or for the symmetrical force generation in the actuation element which is coupled to the bending beam.

As explained above, it is possible that the dies are directly mounted and fixed at an actuation element. For another embodiment of the invention, the actuation element comprises guidances for the dies. The other actuation element comprises actuating surfaces for the dies. In this case, a relative movement of the actuation elements causes a movement of the dies relative to the guidances which is caused by the contact of the actuation surfaces with the dies. In this context there is preferably both a sliding movement of the dies relative to the guidances of the one actuation element as well as a sliding and/or rolling movement of the dies relative to the actuation surfaces of the other actuation element.

It is also possible that the actuation elements are pivoted relatively to each other about the die axis. In this case an actuation element is e.g. built by a pivot ring. In this case it is possible that the dies are pivotably mounted to the guidances, in particular by a bearing bolt which is held at the pliers head and supports or bears the dies with a bearing axis which is fixed with respect to the pliers head. The relative pivoting movement of the actuation elements results in a pivoting movement of the dies relative to the guidances. This pivoting movement of the dies is caused by the contact of the actuation surfaces of the actuation element with the dies.

Generally, the crimping pliers might also be used only for one type, one geometry and/or one cross-sectional area of the workpiece. In a preferred embodiment of the invention, it is possible to crimp workpieces of differing cross-sectional areas to be crimped with the crimping pliers by use of the force-displacement-compensation due to the force-displacement-compensation element and/or by use of the movement of the roller along the curved track with a change of the sizes and angles of the toggle lever drive. Here, it is possible that the cross-sectional areas of different workpieces which can be crimped with one and the same crimping pliers (without an exchange of an exchange head or an exchange of dies) might differ from each other by a factor of at least 30 (in particular a factor of at least 45, 50, 75, 100, 115 or even 200). In order to mention one example, it might be possible to crimp workpieces with a cross-sectional area of 0.08 $mm^2$, 0.14 $mm^2$, 0.25 $mm^2$, 0.35 $mm^2$, 0.5 $mm^2$, 0.75 $mm^2$, 1.0 $mm^2$, 1.5 $mm^2$, 2.5 $mm^2$, 4 $mm^2$, 6 $mm^2$, 10 $mm^2$ and 16 $mm^2$ with one and the same crimping pliers.

In the opening position of the crimping pliers, the dies build an accommodation for the workpiece which has to be at least as large as the largest workpiece which is to be crimped with the crimping pliers. The smaller the workpiece is which is actually inserted into the accommodation built by the dies in the opening state, the larger is the play and the worse is the guidance and fixation of the workpiece in the pliers head in the opening state. In order to provide an accommodation and exact orientation of the smaller workpiece in the crimping pliers at the beginning of the crimping process itself, it would be necessary to provide a partial closing movement and a fixation of the drive elements such that the accommodation built by the dies is made smaller to an extent such that the smaller workpiece is accommodated with a close fit. For an alternative or cumulative embodiment, the invention proposes that a positioning device is located at the pliers head. By the positioning device a workpiece with a predetermined cross-sectional area is held in an accommodation (preferably also workpieces with differing cross-sectional areas in a plurality of accommodations) in a predefined position and orientation at the pliers head before the crimping process starts. Here, the positioning device is preferably only equipped with suitable accommodations for a part of the different workpieces which will be crimped with the pliers and for a part of the different cross-sectional areas.

For a particular proposal of the invention, the invention proposes to guide the spring element by a guidance. The guidance is preferably a guidance which is additional to other couplings of the spring element with the adjacent components of the crimping pliers. So, the guidance is in particular additional to the drive connection of the spring element with the actuation element and additional to the coupling of the spring element in the region of the other spring base with the drive element or hand lever. Here, the additional guidance might be provided in the region of the spring base or at any other place of the spring element between the spring bases. The guidance might permanently or only temporarily during a part of the working stroke be effective. By means of the guidance, it is possible to provide a guidance of the spring element in circumferential direction around the die axis and/or radially to the die axis. It is also possible that in the guidance the spring element is biased under a pretension against a protrusion or step or shoulder or into an end position. Only when overcoming the pretension during the travel through a part of the working stroke of the crimping pliers, the spring element might be released and accordingly a movement along the guidance takes place. For this design, the spring element might be equipped with a specific "non-linearity" because with the release of the spring element from the protrusion or step or shoulder the boundary conditions for the elastic deformation of the spring element change. Here, it is possible that the guidance is e.g. provided by a housing or a cover plate of the pliers head. However, it is also possible that the guidance of the spring element is provided by a component of the crimping pliers which is moved during the working stroke. For a specific embodiment of the invention, the guidance is provided in the region of the spring element with respect to another region of the spring element.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if an element is mentioned, this is to be understood such that there is exactly one element or there are two elements or more elements. Additional features may be added to these features, or these features may be the only features of the respective product.

The reference signs contained in the claims are not limiting the extent of the matter protected by the claims. Their sole function is to make the claims easier to understand.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
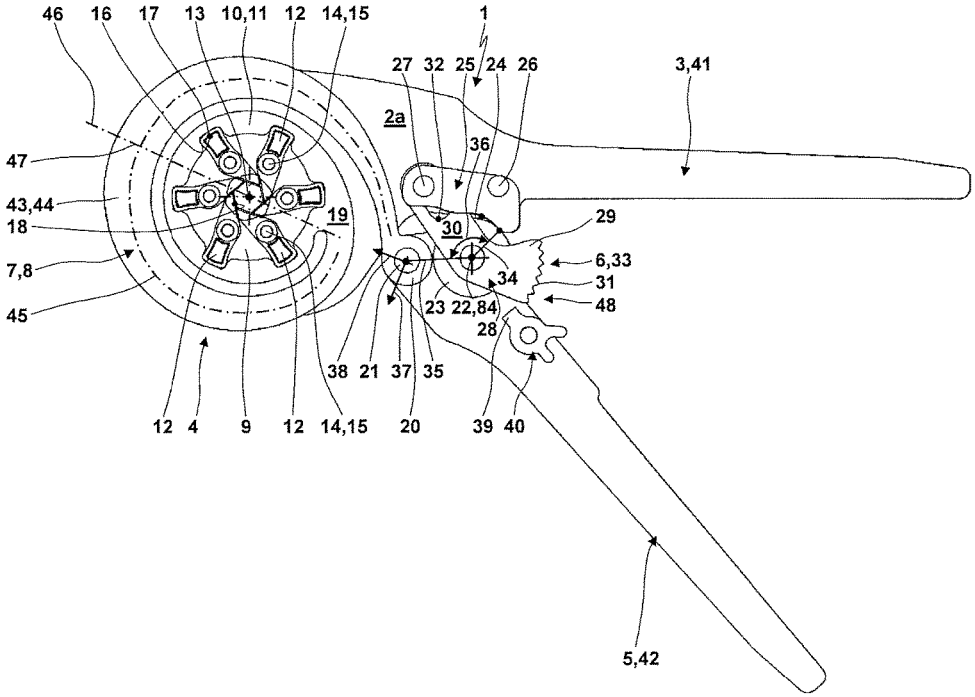
FIGS. 1 to 11 show a first embodiment of the crimping pliers in an open position (FIG. 1), a closed position (FIG. 2), with components of the crimping pliers in an exploded view (FIGS. 3 and 4), with a guiding part with curved tracks in a three-dimensional single part drawing (FIG. 5), with a toggle lever angle of the crimping pliers in the open position (FIG. 6) and in the closed position (FIG. 7) and with the actuating force curves for different workpieces (FIG. 8) and with the dimensions of the spring element (FIGS. 9 and 10) and with the resulting curves for the tension in the spring element (FIG. 11).

FIG. 1 shows crimping pliers 1 in an illustration wherein one of two cover plates 2*a*, 2*b* with which a fixed hand lever 3 and a pliers head 4, in particular in a kind of "housing" of the pliers head 4, is built, is disassembled.

The crimping pliers 1 are built with a fixed hand lever 3 and a movable hand lever 5. A pivoting of the hand levers 3, 5 towards each other (cp. the transition from FIG. 1 to FIG. 2) via a drive mechanism 6 and a spring element 7, which builds a force-displacement-compensation element 8 generates a relative movement of actuation elements 9, 10. Here, the actuation element 9 is integrally built by the part of the cover plate 2 which extends in the region of the pliers head 4 so that a fixed actuation element 9 is built. Instead, the actuation element 10 is a movable actuation element 10 in the form of a pivot ring 11 which can be pivoted relative to the fixed actuation element 9 about a workpiece axis or die axis 13 defined by dies 12. Here the die axis 13 has an orientation perpendicular to the plane of illustration according to FIG. 1. The dies 12 are pivotable about axes which have an orientation parallel to the die axis 13 and which are supported by bearing bolts 14 which are held at the actuation element 9 or the cover plate 2. The bearing bolts 14 accordingly build guidances 15 for the dies 12. At the radial inner side in the region of grooves the pivot ring 11 forms actuation surfaces 16 at which counter-actuation surfaces 17 of the dies 12 contact so that a pivoting of the pivot ring 11 about the pivot axis 13 results in a pivoting movement of the dies 12 around the bearing bolts 14. The pivoting movement of the dies 12 again has the consequence that a die contour 18 changes its size. Here, the die contour is defined by the dies 12 and closed in circumferential direction around the die axis 13 under the build-up of a minimal gap between the adjacent dies 12. For the shown embodiment the die contour 18 is hexagonal in a first approximation independent from the size of the same.

The spring element 7 is built by an integral protrusion of the pivot ring 11 which extends in circumferential direction around the pivot axis 13 with the shape of an arc of a circle or here a spiral form. For the shown embodiment the circumferential angle is approximately 360°. The spring base 19 building the connecting region with the pivot ring 11 as well as the outer spring base 20 of the spring element 7 are approximately located in a 4o'clock position with respect to the die axis 13 for the illustration according to FIG. 1 wherein the fixed hand lever 3 has a horizontal orientation. The spring base 20 is pivotably liked, here by a bearing bolt 21 at the movable hand lever 5. A roller 23 is supported for being rotated at the movable hand lever 5, here by a bearing bolt 22. The roller 23 contacts a curved track 24 of a guiding part 25. In the present case, by the curved track 24 the guiding part 25 only guides the roller 23 on one side. However, for another embodiment it is also possible that the roller 23 is accommodated between two curved tracks which might be the case with some play or without any play. The guiding part 25 is rigidly fixed to the fixed hand lever 3, here by bearing bolts 26, 27. By the bearing bolt 22 also a toothed latching lever 28 is supported for being pivoted. The toothed latching lever 28 is built with lever parts 29, 30. In the outer end region the lever part 29 forms a toothing 31 for latching. The lever part 30 comprises an elongated hole 32 having an orientation radially to the bearing bolt 22. The bearing bolt 27 extends through the elongated hole 32.

The drive mechanism 6 is formed by a toggle lever drive 33. The toggle lever drive 33 comprises a toggle lever 34 which corresponds to the connection between the contact point of the roller 23 with the curved track 24 and a second toggle lever 35 which corresponds to the connection between the bearing axes defined by the bearing bolts 21, 22. A toggle lever angle 36 is built between the toggle levers 34, 35.

Figure 2:
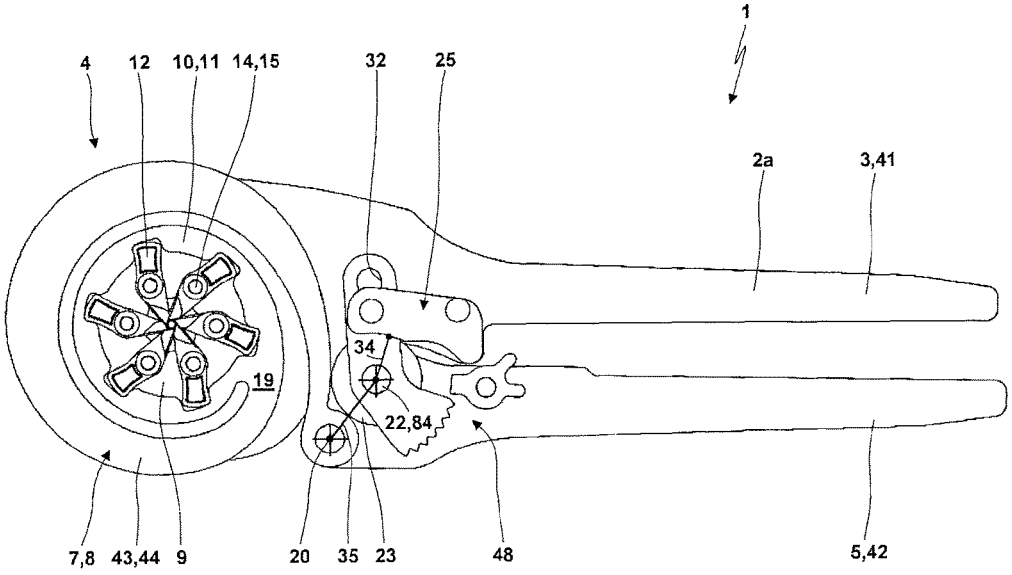

During the working stroke of the crimping pliers 1 from the open position according to FIG. 1 to the closed position according to FIG. 2, the movement of the hand levers 3, 5 in a first part of the stroke with neglectable crimping forces and with a support of the roller 23 at the curved track 24 of the guiding part 25 leads to the result that the bearing bolt 21 and therewith also the spring base 20 of the spring element 7 move in circumferential direction 37 around the die axis 13. Due to the neglectable crimping forces, there is no elastic deformation of the spring element 7. Accordingly, there is a corresponding pivoting movement of the pivot ring 19 which again coincides with a pivoting movement of the dies 12 and a reduction of the cross-sectional area of the die contour 18. Due to the fact that the contact point of the roller 13 with the curved track 24 of the guiding part 25 is not fixed, the roller 23 is able to roll along the curved track 24 during this part of the stroke. Dependent on the rolling movement of the roller 23 and on the geometry of the curved track 24, a changed toggle lever angle 36 results. This complex kinematic is superimposed by an increased elastic deformation of the spring element 7 with an increase of the crimping forces in the region of the die during closing movement. This shall be illustrated on the basis of a theoretical limit case for which it is assumed that the workpiece after a first part of the stroke (which might e.g. be formed by an empty stroke) and after a second part of the stroke (by which the workpiece is crimped with a plastic deformation of the same) the workpiece is ideally rigid in the last third part of the stroke. When reaching the ideally rigid state of the workpiece, the position of the dies 12 and the pivot ring 11 and accordingly also of the spring base 19 is also fixed. However, a further closing movement of the hand levers 3, 5 is possible in the third part of the stroke because with the further actuation of the hand levers 3, 5 the spring element 7 is elastically deformed. On the one hand side, the spring base 20 is deformed in circumferential direction 37. It is also possible that the spring base 20 is deformed in radial direction 38 of the die axis 13. Accordingly, despite of the rigid workpiece and fixed dies 12, fixed pivot ring 11 and fixed spring base 19, a rolling movement of the roller 23 along the curved track 24 takes place with the transfer of the hand levers 3, 5 into the closed state. For realistic stiffnesses of the workpiece there is a superposition of a plastic deformation of the workpiece (which becomes smaller with increasing crimping force) with an elastic deformation of the spring element 7, wherein the percentage of the elastic deformation of the spring element 7 relative to the plastic deformation of the workpiece becomes larger and larger with increasing crimping force. Accordingly, in practice in some cases there is a superposition of the second part of the stroke and the third part of the stroke.

Dependent on the cross-sectional area of the workpiece to be crimped, the position of the different parts of the stroke over the working stroke of the crimping pliers 1 changes:

- For a large workpiece an empty stroke building the first part of the stroke (e.g. between 0% and 15% of the working stroke) is very short. A plastic deformation of the workpiece takes place in a second part of the stroke, e.g. already at the beginning of the working stroke (e.g. between 15% and 60% of the working stroke), whereas a larger third part of the stroke (e.g. between 60% and 100% of the working stroke) follows in which primarily the spring element 7 is deformed.
- For a smaller workpiece an empty stroke building the first part of the stroke (e.g. between 0% and 30% of the working stroke) is longer. A plastic deformation of the workpiece follows in a second part of the stroke in a later part of the working stroke (e.g. between 30% and 80% of the working stroke), whereas a smaller third part of the stroke (e.g. between 80% and 100% of the working stroke) or even no third part of the stroke follows wherein primarily the spring element 7 is deformed.

At the same time with the pivoting movement of the hand levers 3, 5 towards each other, the toothed latching lever 28 is pivoted. During the pivoting movement of the toothed latching lever 28 a latching nose 39 of a latching pawl 40 which is also mounted for a pivoting movement at the hand lever 5 under the bias of a spring 93 slides ratchet-like along the toothing 31 for latching. If the hand forces applied to the hand levers 3, 5 are temporarily reduced or completely removed, the engagement of the latching nose 39 into the toothing 31 for latching blocks the opening movement of the hand levers 3, 5 and therewith also an opening movement of the dies 12. Only if the hand levers 3, 5 have completely reached the closed state, the latching nose 39 has completely passed the toothing 31 for latching so that the latching pawl 40 is able to turn over and to slide in a ratchet-like fashion during an opening movement of the hand levers 3, 5 back into its starting position (which by use of the toothing 31 for latching is only possible when having completely passed the toothing 31 for latching). A forced locking unit 48 is built with the toothed latching lever 28 and the latching pawl 40 biased by the spring 39.

For the general design of crimping pliers 1 with a pivot ring 11 and the provision of a common pivoting movement of here six dies 12 by a relative rotation of the actuation elements 9, 10, reference is made to the prior art, in particular EP 0 732 779 B1 and DE 10 140 270 B4 and DE 10 2005 003 615 B3. In the present case, the hand levers 3, 5 build drive elements 41, 42 upon which the manual actuation forces are applied. It will be understood that it is also possible that the drive elements 41, 42 are biased by forces of an actuator as an electrical drive.

Here, the spring element 7 is built by a type of bending beam 43. In the region of the spring base 20 force components in circumferential direction 37 and/or in radial direction 38 are introduced into the bending beam 43. These force components result in the bias of the bending beam 43 around a bending axis which has an orientation perpendicular to the plane of illustration according to FIG. 1. Here, generally also the use of a bias of the bending beam 43 by a pressing force resulting in a buckling is possible. However, preferably the bending beam 43 is biased by a pulling force in circumferential direction 37. For the shown embodiment the bending beam 43 is built by a spiral spring or a spring 44 having the shape of an arc of a circle extending in the plane of illustration according to FIG. 1. Here, the spiral spring or spring with the shape of an arc of a circle extends in circumferential direction 37 around the die axis 13.

The bending beam 43 comprises a neutral fiber or longitudinal axis 45 which here has the shape of an arc of a circle or a spiral shape. The bending stiffness changes along the neutral fiber or longitudinal axis 45, in particular due to a change of the geometric moment of inertia. For the shown embodiment the design of the size of the cross-section of the bending beam 43 which determines the geometric moment of inertia is symmetrical to a symmetry axis which runs through the die axis 13 and the spring base 20. In the same way the heights and the cross-sectional area of the spring element 7 is maximal in a cross-section 47 which is located in the middle in circumferential direction between the spring bases 19, 20.

Figure 3:
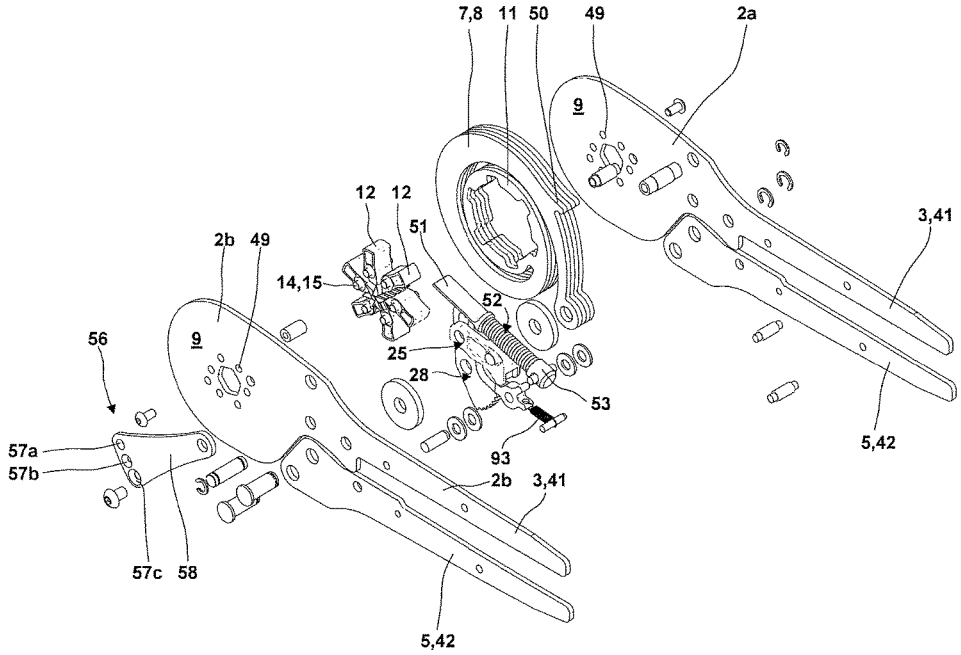

In the explodes view of FIG. 3 it can be seen that the crimping pliers are built with two cover plates 2*a*, 2*b*. The two cover plates 2*a*, 2*b* build the fixed hand lever 3. On the other hand, the cover plates 2*a*, 2*b* build a kind of housing of the pliers head 4. Between the cover plates 2*a*, 2*b* the movable parts, namely the spring element 7, the pivot ring 11 and the dies 12 are accommodated. On the other hand, the bearing bolts 14 for the dies 12 are accommodated in bores 49 of the cover plates 2*a*, 2*b*.

Furthermore, in FIG. 3 it can be seen that the spring element 7 and the pivot ring 11 are formed by a plate design, here with four plates. The single plates for the pivot ring 11 and the spring element 7 are built as integral parts.

Differing from the embodiment shown in FIGS. 1 and 2, according to FIG. 3 the spring element optionally comprises a protrusion 50 at its outer side. A spring base 51 or a plug or stem coupled with any such spring base of another spring 52 is supported at the protrusion 52. The other spring base 53 of the other spring 52 is supported at the cover plates 2*a*, 2*b* or at the movable hand lever 5. By the other spring 52 it is possible to influence the force conditions at the crimping pliers 1 additionally to the spring element 7. Accordingly, the other spring 52 can be used for manipulating the dependency of the produced crimping force from the pivot angles of the hand levers and from the actuating force applied to the hand levers. It is also possible that by the other spring 52 the contact force of the roller 23 with the curved track 24 of the guiding part 25 is increased or provided.

Figure 4:
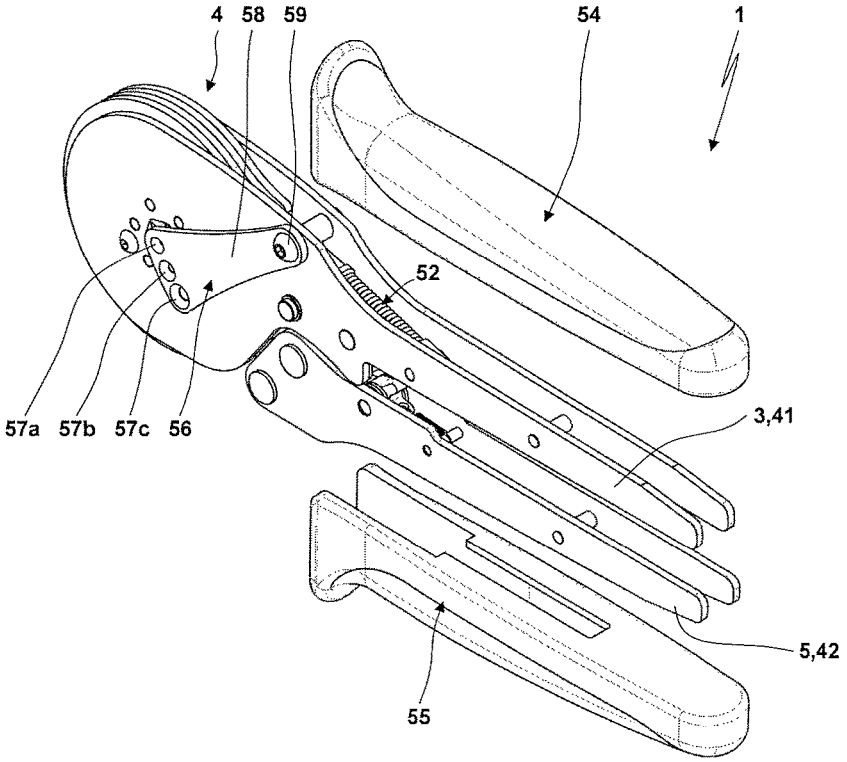

FIG. 4 shows the assembled basic components of the crimping pliers 1 according to FIG. 3 before being assembled with handles 54, 55 associated with the two hand levers 3, 5.

According to FIGS. 3 and 4, it is possible that the crimping pliers 1 comprises a positioning device 56. For the shown embodiment the positioning device 56 comprises three alternative accommodations 57*a*, 57*b*, 57*c* for workpieces with differing cross-sectional areas. The positioning device 56 can be brought into different operating positions in which a respective one of the accommodations 57*a* (57*b*, 57*c* ) is arranged with an orientation coaxial to the die axis. 13. For the shown embodiment the positioning device 65 is built with a positioning strut or a positioning disc 58 which is supported for being pivoted at the cover plates 2, here by a bearing bolt 50. The positioning strut or positioning disc 58 directly and slidingly contacts the outer side of the cover plate 2*b*.

Figure 5:
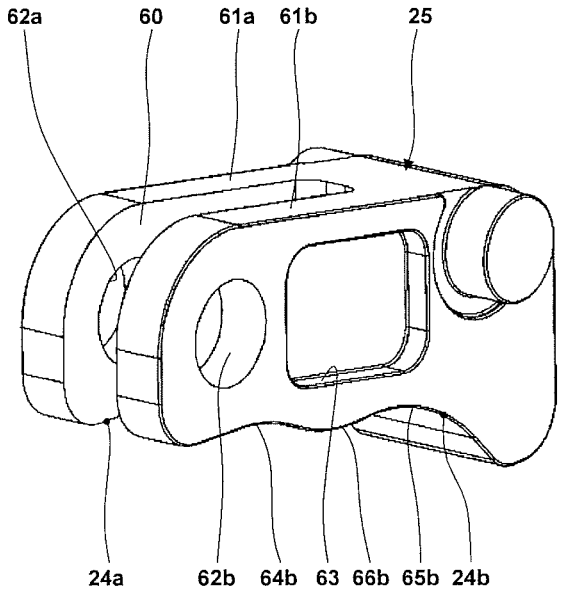

As shown in FIG. 5, the guiding part 25 has a fork-like shape with the formation of a slit 60 between two legs 61*a*, 61*b*. Under the provision of a relative pivoting movement the toothed latching lever 28 extends through the slit 60 of the guiding part 25 (cp. also FIG. 3). In the outer end region the legs 61*a*, 61*b* each have a bore 62*a*, 62*b* through which the bearing bolts 27 extend in the assembled state. For weight reasons the legs 61*a*, 61*b* might comprise recesses 63.

In FIG. 5 it can be seen that for the shown embodiment the two legs 61*a*, 61*b* form two parallel curved tracks 24*a*, 24*b* at which the two roller 23*a*, 23*b* on both sides of the toothed latching lever 28 roll along. Furthermore, it can be seen that for the shown embodiment the curved tracks 24*a*, 24*b* comprise two concave partial regions 64, 65 between which a convex partial region 66 is located. Here, the curved track 24 has a larger inclination in the concave partial region 65 which is run through at the beginning of the working stroke than in the other partial regions of the curved track 24.

Figure 6:
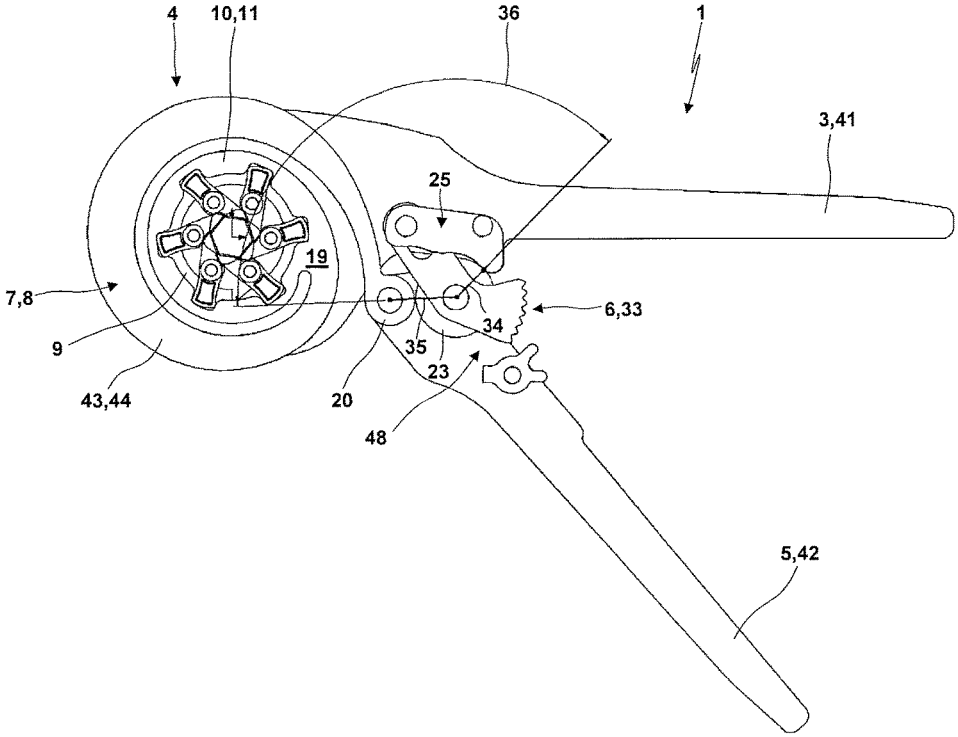
Figure 7:
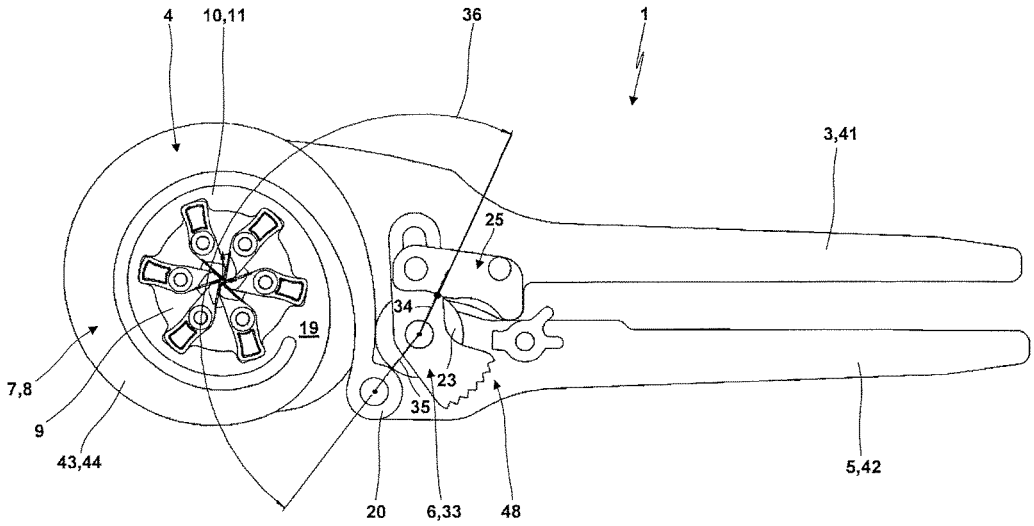

By a choice of a suitable shape of the curved track 24 it can be provided that the toggle lever angle 36 of the toggle lever drive 33 is comparatively large during the whole working stroke. According to FIG. 6, at the beginning of the working stroke the toggle lever angle 36 is approximately 135°, whereas the toggle lever angle 36 is in the range between 160° to 180° at the end of the working stroke according to FIG. 7. Preferably, the toggle lever angle 36 is during the whole working stroke always between 130° and the stretched angle of 180° which is due to

- a suitable shape of the curved track 24,
- a choice of the characteristic and geometry of the spring element as well as
- the dimensioning of the drive mechanism 6.

Figure 8:
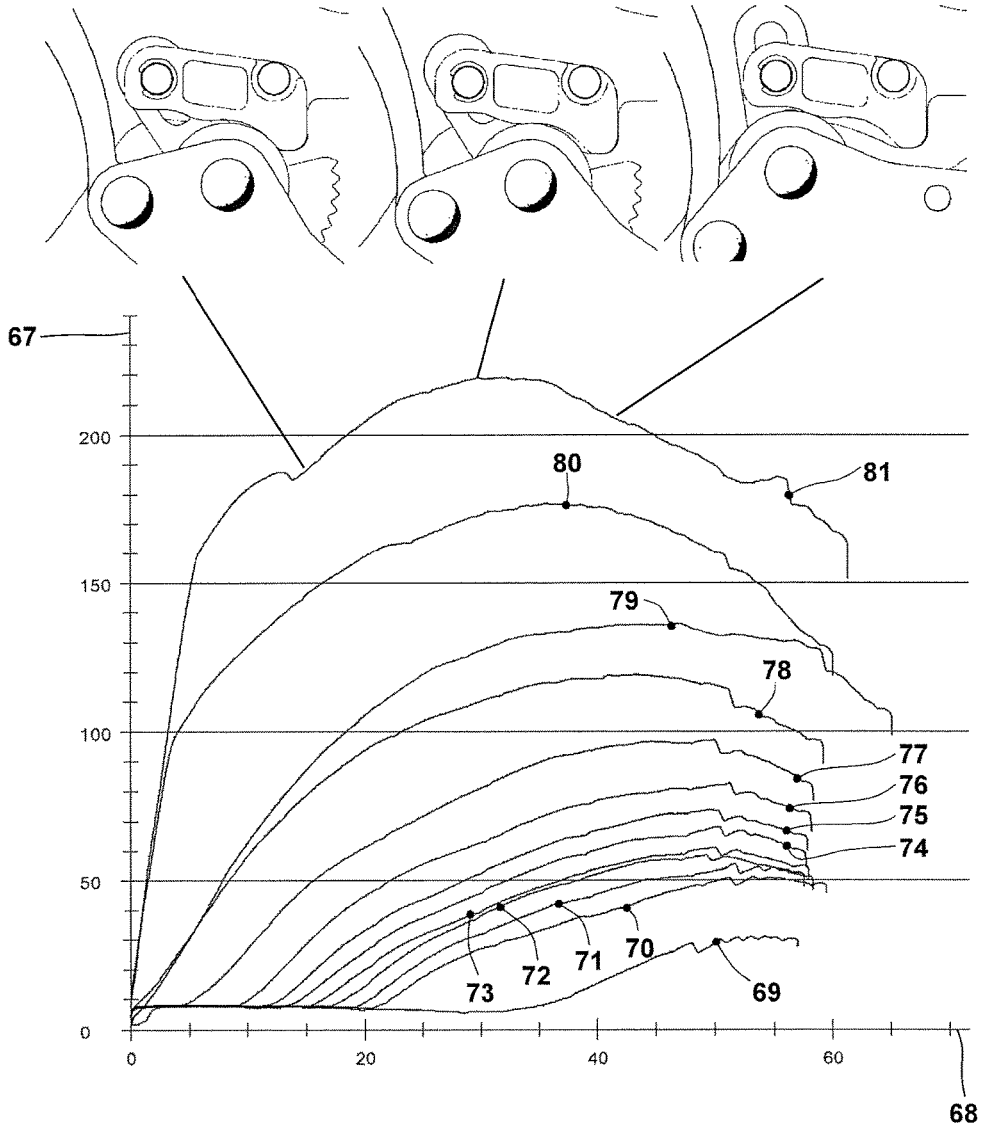

FIG. 8 shows the hand forces 67 being required as a function of the actuation displacement 68 of the movable hand lever 5. Here, the curves 69 to 81 show the curves for the hand force for differing cross-sectional areas of the workpieces, namely 0.08 $mm^2$ (69), 0.14 $mm^2$ (70), 0.25 $mm^2$ (71), 0.35 $mm^2$ (72), 0.5 $mm^2$ (73), 0.75 $mm^2$ (74), 1.0 $mm^2$ (75), 1.5 $mm^2$ (76) 2.5 $mm^2$ (77), 4 $mm^2$ (78), 6 $mm^2$ (79), 10 $mm^2$ (80) and 16 mm (81). Here it can be seen that for smaller workpieces at first the starting first part of the stroke is run through with neglectable crimping forces, whereas the actual hand forces are only applied at the end of the working stroke. With increasing size of the workpiece the rising of the curves 69 to 81 is shifted towards smaller actuating displacements. In FIG. 8 it can be seen that a crimping of all of the mentioned workpieces is possible with one and the same crimping pliers 1 by controllable hand forces which are preferably smaller than 300 N.

Figure 9:
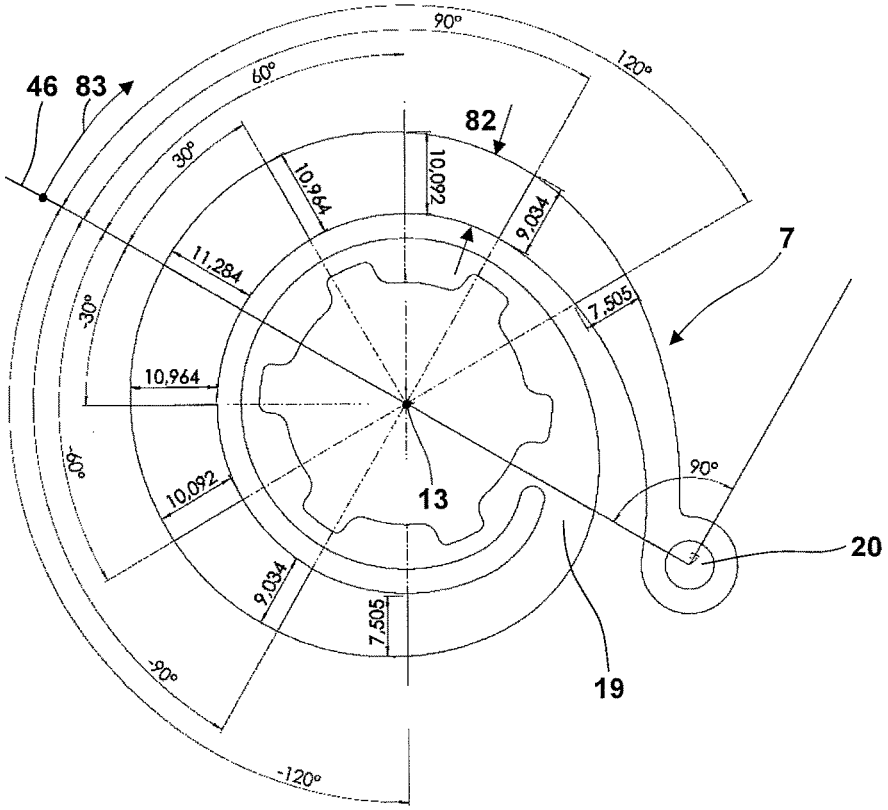
Figure 10:
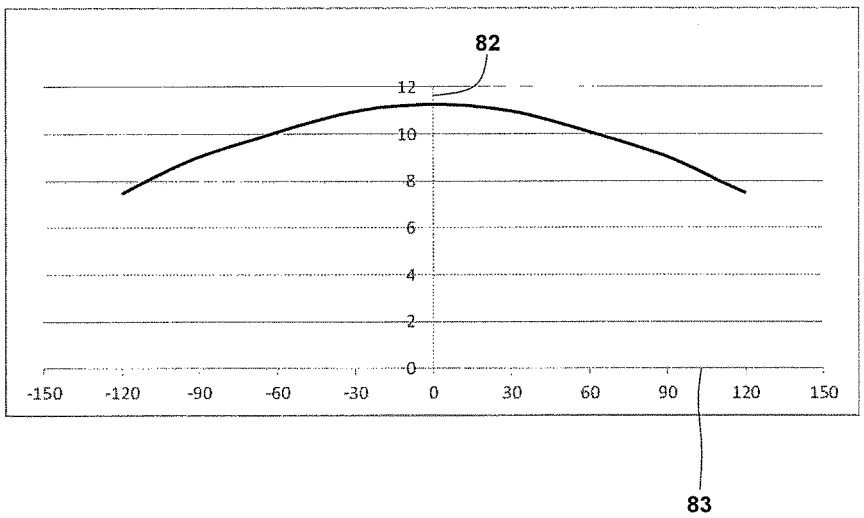

FIG. 9 shows an example for the choice of the dimensions of the spring element 7. It can be seen that the spring element spirally extends around the die axis 13 with an angle in circumferential direction of approximately 360°. The effective height 82 of the spring element 7 for influencing the geometric moment of inertia is symmetrical to the symmetry axis 46 or increases from both spring bases 19, 29 in the same extent to the middle of the spring element 7 in circumferential direction between the two spring bases 19, 20. Whereas in FIG. 9 only discrete values of the heights 82 of the spring element 7 are given, FIG. 10 shows the dependency of the heights 82 from the circumferential angle 83 starting from the location in the middle between the two spring bases 19, 20.

Figure 11:
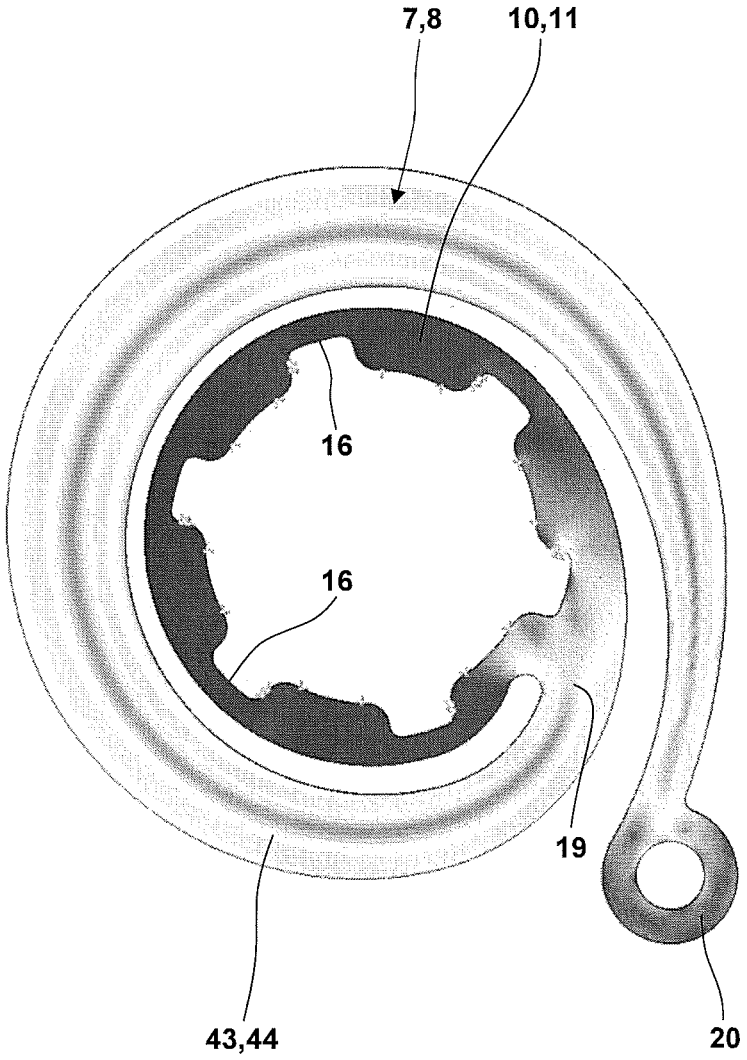

FIG. 11 shows the distribution of the tension in the spring element 7, wherein here for the same tension the same grey scale has been used. By means of the symmetric design of the spring element 7 and the choice of the heights 82 according to FIG. 10, it can be provided that the maximum of the tension in the spring element 7 remains constant along the circumference or along the longitudinal axis 45.

Figure 12:
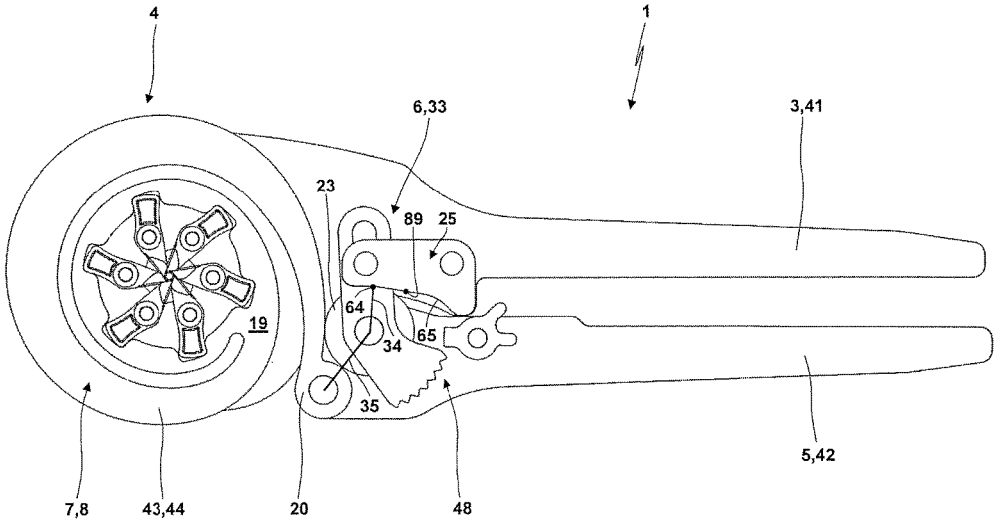
FIG. 12 shows another embodiment of the crimping pliers.

FIG. 12 shows another embodiment of the crimping pliers 1 which generally corresponds to the embodiment shown in FIGS. 1 to 11. However, here the contour of the curved track 24 has been chosen such that the contour only comprises concave partial regions 64, 65 which are connected with each other by a straight partial region 89.

Figure 13:
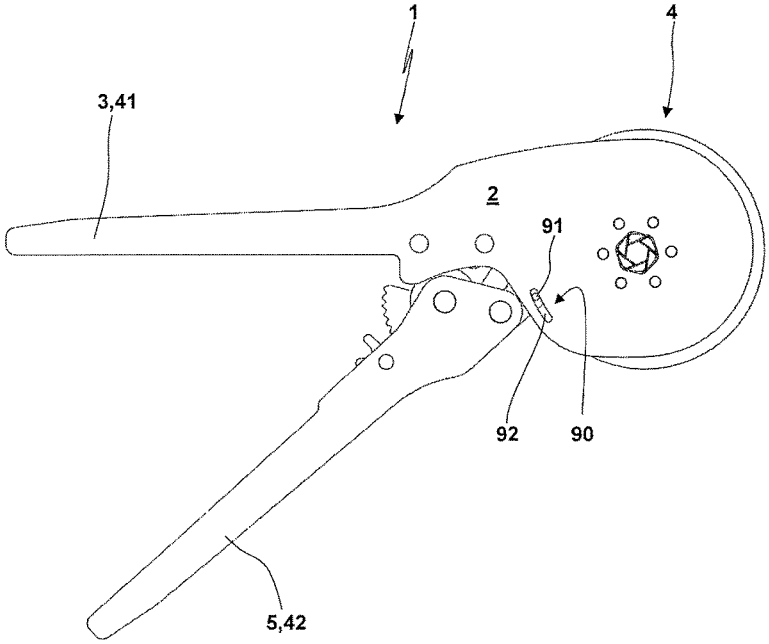
FIGS. 13 to 14 show another embodiment of the crimping pliers with an additional guidance of the spring element.
Figure 14:
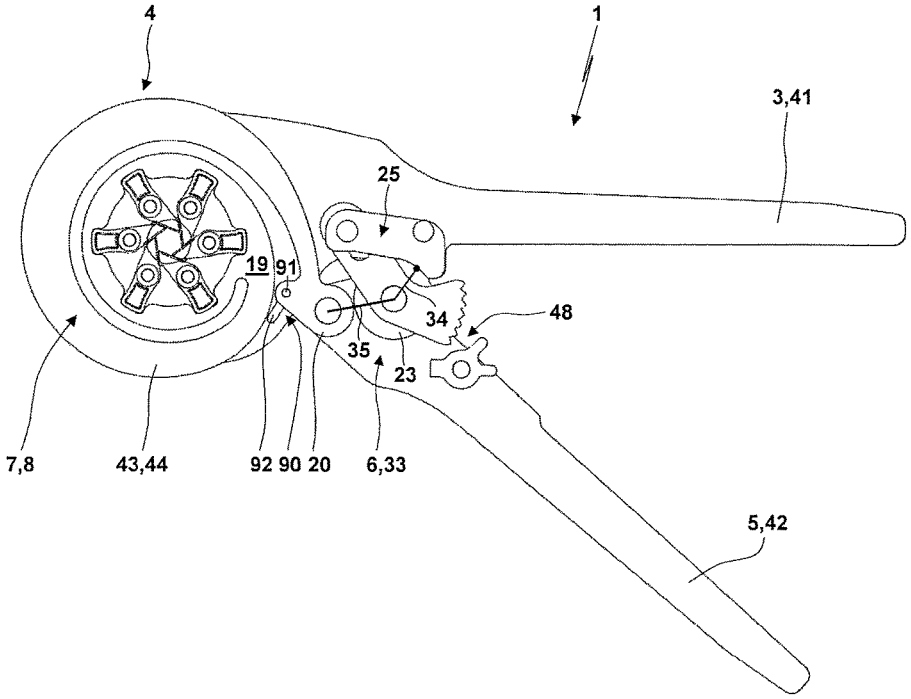

FIGS. 13 and 14 show another embodiment of crimping pliers, wherein FIG. 13 shows the crimping pliers in the open position with assembled cover plate and FIG. 14 shows the crimping pliers also in the open position but with disassembled cover plate. This embodiment generally corresponds to the embodiment of the crimping pliers 1 according to FIGS. 1 to 11 or FIG. 12. However, here the spring element 7 is guided in an additional guidance 90. For the shown embodiment, the guidance is provided in the region of the spring base 20. The guidance 90 is built by a guiding pin 91 held by the spring element 7. The guiding pin 91 is guided in a guiding groove or an elongated hole 92 of the cover plates 2. Preferably, the elongated hole 92 extends in circumferential direction around the pivot axis 13.

For the shown embodiment the guiding part 25 is mounted to the fixed hand lever 3, whereas the roller 23 is mounted for being pivoted at the movable hand lever 5. However, it is also possible that the guiding part 25 is fixedly mounted to the movable hand lever 5, whereas the roller 23 is mounted for being rotated at the fixed hand lever 3.

It is possible that within the frame of the invention the same base construction is used for crimping pliers actuated by hand and for crimping pliers actuated by an external force. However, in this case hand levers are used as the drive elements for the manually actuated crimping pliers, whereas for the crimping pliers actuated by an external force instead of the hand levers drive elements linked with an actuator will be used. To mention a simple non-limiting example, for crimping pliers actuated by an external force it is also possible that the fixed (hand) lever is shortened and supported at a fixed counter bearing, whereas a crank plug, a stem or plug or the like of an actuator is linked to the movable (in some cases also shortened) (hand) lever. In some cases crimping pliers being actuated by an external force do not comprise a forced locking unit.

Many variations and modifications may be made to the preferred embodiments of the invention without departing substantially from the spirit and principles of the invention.

All such modifications and variations are intended to be included herein within the scope of the present invention, as defined by the following claims.

I claim:

1. Crimping pliers for crimping a workpiece comprising
a) two drive elements,
b) a pliers head connected to the two drive elements and comprising,
ba) two actuation elements, the actuation elements linked to and actuating dies between which the workpiece can be crimped,
c) a toggle lever drive linked to both the drive elements and the actuation elements,
ca) wherein the toggle lever drive comprises two toggle levers,
cb) wherein the toggle levers are connected at a toggle lever angle which changes over a working stroke,
d) wherein one toggle lever comprises a roller having a roller axis which
da) is mounted to a first one of the drive elements for being pivoted around said roller axis and
eb) rolls along a curved track, said curved track being fixedly connected to the second drive element,
e) a forced locking unit comprising a toothed latching lever, said toothed latching lever being mounted to the first drive element and pivots with respect to both
ea) the first drive element and
eb) the roller, wherein the toothed latching lever is mounted to the first drive element and forms a pivot joint with respect to the first drive element, wherein the toothed latching lever, the drive element at which the roller is pivot mounted and the rollers are pivoted relative to each other,
f) a sliding guide wherein a first lever part of the toothed latching lever is coupled by said sliding guide with the second drive element and
g) a second lever part of the toothed latching lever forms a toothing comprising teeth for latching of the forced locking unit.

2. The crimping pliers of claim 1, wherein the toothed latching lever is rotatably mounted about the roller axis at the first drive element.

3. The crimping pliers of claim 2, wherein the roller and the toothed latching lever are supported on a common bearing bolt.

4. The crimping pliers of claim 1, wherein the sliding guide comprises an elongated hole.

5. The crimping pliers of claim 4, wherein a bearing bolt
a) guides the toothed latching lever in the elongated hole and
b) fixes a guiding part forming the curved track.

6. The crimping pliers of claim 1 further comprising, a force-displacement-compensation element comprising a spring element.

7. The crimping pliers of claim 6, wherein the spring element is guided by a guide.

8. The crimping pliers of claim 7, wherein the spring element comprises a bending beam.

9. The crimping pliers of claim 8, wherein the spring element comprises a plate-design with at least two plates.

10. The crimping pliers of claim 8, wherein the spring element comprises a spring having the shape of an arc of a circle or comprises a spiral spring.

11. The crimping pliers of claim 9, wherein the spring element comprises a spring having the shape of an arc of a circle or comprises a spiral spring.

12. The crimping pliers of claim 1, wherein
a) a first one of the actuation elements comprises guidances for dies and
b) a second one of the actuation elements comprises actuation surfaces for the dies,
c) wherein a relative movement of the actuation elements causes a movement of the dies relative to the guidances which is caused by the contact of the actuation surfaces with the dies.

13. The crimping pliers of claim 12, wherein
a) the actuation elements are pivoted relative to each other about the pivot axis,
b) the dies are mounted for being pivoted relative to the guidances and
c) the relative pivoting movement of the actuation elements causes a pivoting movement of the dies relative to the guidances which is caused by the contact of the actuation surfaces with the dies.

14. The crimping pliers of claim 1, wherein by use of
a) a force-displacement-compensation provided by a force-displacement-compensation element and/or
b) a movement of the roller along the curved track with a change of a size and angular conditions of the toggle lever drive
crimp workpieces with differing cross-sectional areas to be crimped, wherein for two different workpieces crimped with the crimping pliers the cross-sectional areas differ by at least a factor 30.

15. The crimping pliers of claim 1, wherein the pliers head further comprises a positioning device for at least one workpiece.

16. The crimping pliers of claim 6, wherein the spring element comprises a bending beam.

17. The crimping pliers of claim 16, wherein the spring element comprises a plate-design with at least two plates.

18. The crimping pliers of claim 17, wherein the spring element comprises a spring having the shape of an arc of a circle or by a spiral spring.

19. The crimping pliers of claim 17, wherein the spring element comprises a spring having the shape of an arc of a circle or by a spiral spring.

* * * * *